United States Patent [19]

Nakamura

[11] Patent Number: 5,038,074

[45] Date of Patent: Aug. 6, 1991

[54] SHADOW-MASK COLOR PICTURE TUBE

[75] Inventor: Koji Nakamura, Nagaokakyo, Japan

[73] Assignee: Mitsubishi Denki Kabushiki Kaisha, Tokyo, Japan

[21] Appl. No.: 375,699

[22] Filed: Jul. 5, 1989

[30] Foreign Application Priority Data

Jul. 28, 1988 [JP] Japan ..... 63-188941

[51] Int. Cl.[5] ..... H01J 29/70; H01J 29/76

[52] U.S. Cl. ..... 313/429; 313/430; 313/431

[58] Field of Search ..... 313/426, 427, 429, 430, 313/431, 432, 433

[56] References Cited

U.S. PATENT DOCUMENTS 3,873,877 3/1975 Machida ..... 313/431
4,331,903 5/1982 Takenaka et al. ..... 313/431

FOREIGN PATENT DOCUMENTS 63-93056 6/1988 Japan .

OTHER PUBLICATIONS

"A New High-Performance Color Picture Tube: The Mask-Focusing Color Tube"; Hiromi Kanai et al., Jan. 1976, pp. 45-49, and FIGS. 1-2.

*Primary Examiner*—Donald J. Yusko
*Assistant Examiner*—Diab Hamadi

[57] ABSTRACT

A shadow-mask color picture tube has an auxiliary deflecting device located between the deflection yoke and shadow mask. In a picture tube with in-line electron guns, the auxiliary deflection device includes a pair of deflection coils, for example, for deflecting the electron beams in the horizontal direction. In a picture tube with delta electron guns, the auxiliary deflection device includes two pairs of deflection coils, for example, for deflecting the electron beams in both the horizontal and vertical directions. The auxiliary deflection devices deflect the electron beams by an amount that closely aligns them with the doming direction of the shadow mask, thereby reducing landing error and improving color purity.

15 Claims, 5 Drawing Sheets

SHADOW-MASK COLOR PICTURE TUBE

BACKGROUND OF THE INVENTION

This invention relates to a shadow-mask color picture particularly it relates to a shadow-mask color picture tube with reduced landing error.

Shadow-mask color picture tubes are used in most color television receivers. The shadow mask is a steel plate disposed behind the screen, perforated by a large number of small holes or slots. Beams from three electron guns are directed toward the shadow mask and pass through the perforations. The three beams that pass through a given perforation land on the screen in three different locations, which are provided with red, green, and blue phosphor coatings. Each beam thus produces a different color.

Shadow-mask color picture tubes are susceptible to a problem known as landing error, this being an error in the locations in which the beams land on the screen. If the landing error is such that a beam lands on a phosphor of the wrong color, the color purity of the image is impaired.

One of the causes of landing error is doming. This occurs when the shadow mask is heated by the impact of the electron beams and expands, the expansion causing the shadow mask to swell outward toward the screen in a dome-like shape.

SUMMARY OF THE INVENTION

An object of the present invention is accordingly to reduce landing error by mitigating the effects of doming.

A shadow-mask color picture tube according to this invention includes electron guns for generating a plurality of electron beams, a deflection yoke having horizontal and vertical deflection coils for deflecting the electron beams in the horizontal and vertical directions, a faceplate coated with phosphors that emit different light of colors when excited by the electron beams, a shadow mask disposed between the deflection yoke and faceplate, and an auxiliary deflection device disposed between the deflection yoke and shadow mask, for deflecting the electron beams in the horizontal direction.

DETAILED DESCRIPTION OF THE EMBODIMENTS

A novel shadow-mask color picture tube embodying the present invention will be described below with reference to the drawings.

Figure 1:
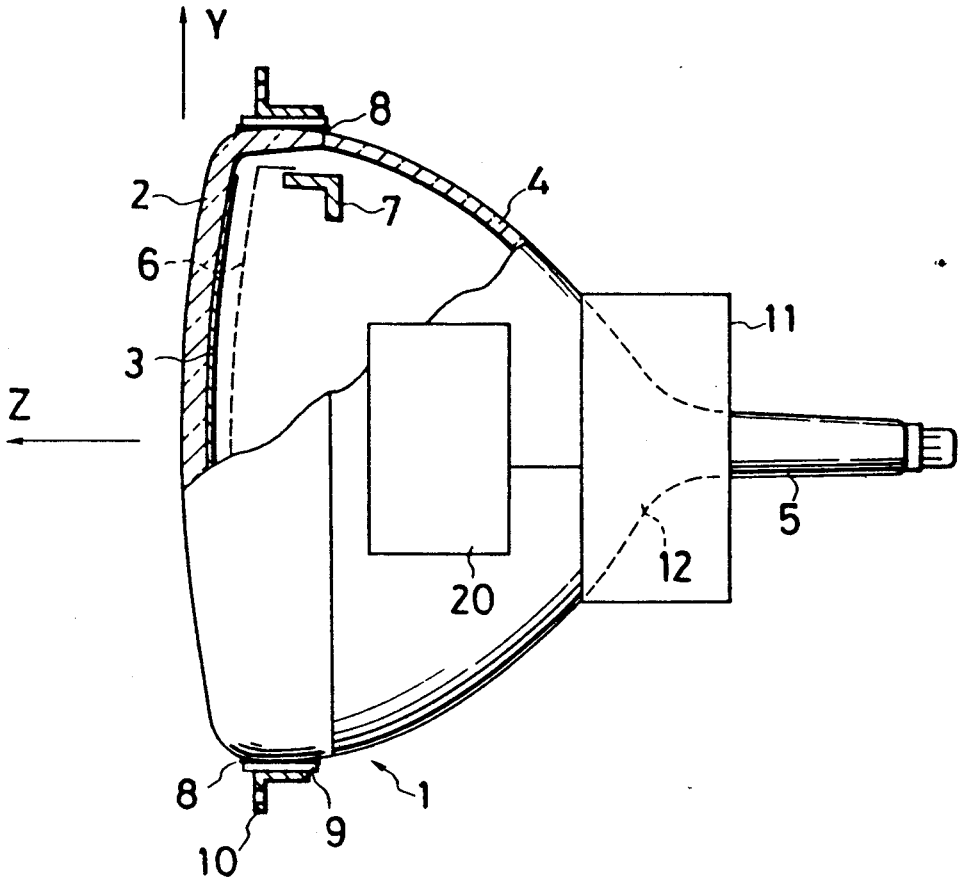
FIG. 1 is a partially cutaway side view of a novel shadow-mask color picture tube embodying the present invention.

FIG. 1 is a partially cutaway side view of the novel shadow-mask color picture tube, which includes an evacuated envelop 1 made of a material such as glass. The faceplate 2 of the envelop 1 is coated on its inner surface with a phosphor 3 including vertical stripes of phosphorescent substances that emit red, green, or blue light when excited by the impact of high-velocity electrons. The faceplate 2 and phosphor 3 will be herein referred to as the screen. From the faceplate 2, the sides of the envelop 1 converge in a funnel 4 to a neck 5, in which are disposed electron guns (which will be shown in FIG. 2) for generating three high-velocity electron beams.

Disposed behind the faceplate 2 is a shadow mask 6, which is a thin sheet of steel perforated by a large number of small boles. The shadow mask can be fabricated from, for example, cold-rolled SPCC steel with a thickness of 0.10 to 0.25 mm. To maintain its rigidity, the shadow mask 6 is mounted in a sturdy metal frame 7.

To prevent implosion in the event of a crack or puncture, the envelop 1 is wrapped with tape 8 at a position just behind the faceplate 2, and a tension band 9 made of pre-stressed steel, for example, is disposed over the tape. Mounting brackets 10 are attached to the tension band 9 for installing the picture tube in a television receiver or other apparatus.

At the back of the shadow-mask color picture tube is mounted a deflection yoke 11, which contains horizontal and vertical deflection coils (not shown in the drawing). These deflection coils are electromagnets &hat receive exciting current and generate a magnetic field that deflects the electron beams in the horizontal and vertical directions, causing the electron beams to scan the screen. The deflection yoke 11 is disposed at the cone 12 of the envelop 1, this being the narrow end of the funnel 4.

The elements mentioned so far are all well-known elements found in prior-art shadow-mask color picture tubes, and can be substantially identical to the elements used in the prior art.

The feature of novelty of the present invention is that it also includes a pair of auxiliary deflection devices 20 disposed at a position intermediate between the deflection yoke 11 and the shadow mask 6. In FIG. 1 the auxiliary deflection devices 20 are shown disposed outside the funnel 4, one on each side. (The auxiliary deflection devices 20 on the far side is not shown in the drawing.) The auxiliary deflection devices 20 include deflection coils electrically coupled to the horizontal deflection coils of the deflection yoke 11 so as to receive part or all of the exciting current applied to those horizontal deflection coils. The auxiliary deflection devices 20 thus generate a magnetic field that deflects the electron beams in the horizontal direction by an amount proportional to their original horizontal deflection in the deflection yoke 11. The direction of the deflection generated by the auxiliary deflection devices 20 is opposite to the direction of the deflection produced in the deflection yoke 11.

Figure 2:
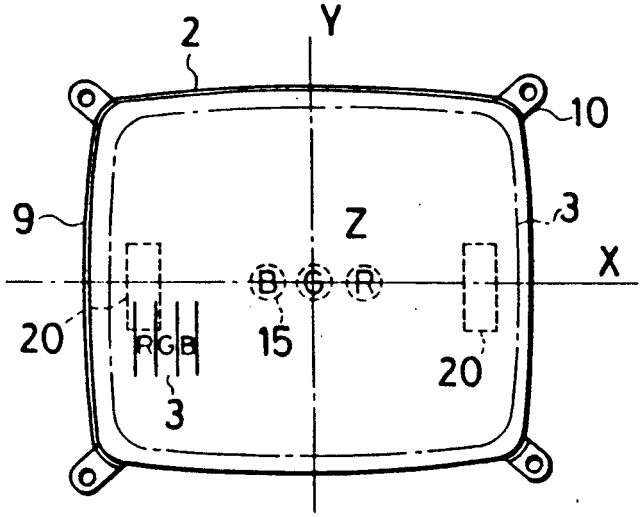
FIG. 2 is a front view of the shadow-mask color picture tube in FIG. 1.

FIG. 2 is a front view of the shadow-mask color picture tube, illustrating a trio of red, green, and blue phosphor stripes 3. The blue, green, and red electron guns 15 are disposed in the neck 5 in an in-line configuration, as indicated in the center of the drawing. The imaginary horizontal line through the center of the faceplate g will be referred to as the x-axis, and the vertical line through the center as the y-axis. The line at right angles to the x- and y-axes, extending from the center of the faceplate back toward the neck 5, will be referred to as the z-axis. The auxiliary deflection devices 20 are disposed on the x-axis, one on the right funnel and one on the left funnel.

Figure 3:
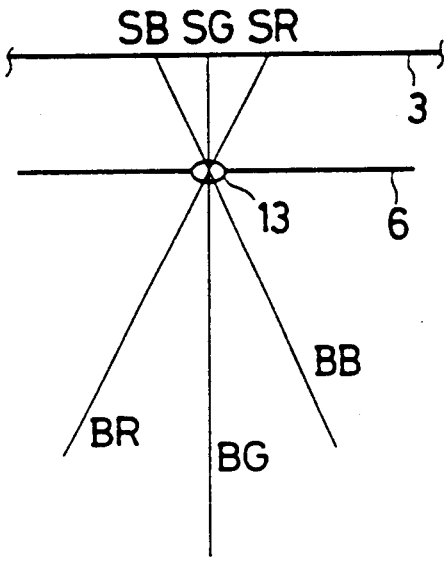
FIG. 3 is a schematic diagram illustrating the function of the shadow mask.

FIG. 3 is a schematic diagram illustrating the operation of the shadow mask 0 as seen from above the screen, looking down the y-axis. Three electron beams labeled BB, BG. and BR from the electron guns 15 pass through a perforation 13 in the shadow mask 6 and land on the phosphor 3. Since the beams come from different directions, they land on the phosphor 3 in different locations SB, SG, and SR, the location SB being disposed in a blue phosphor stripe, SG in a green phosphor stripe, and SR in a red phosphor stripe. Each beam thus produces a different color.

Next doming and landing error will be described with reference to FIGS. 4 to 9.

Figure 4:
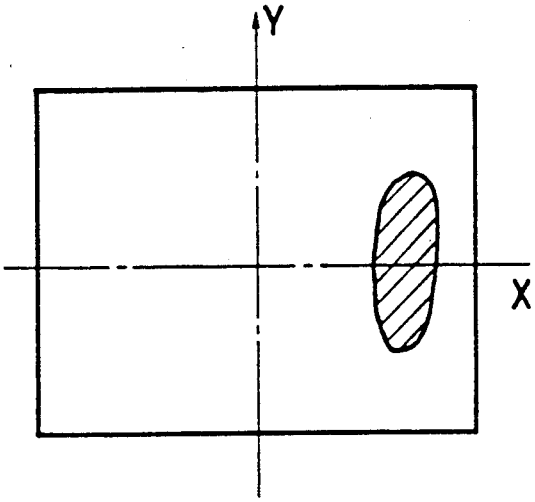
FIG. 4 is a drawing illustrating a particular image pattern on the screen.
Figure 5:
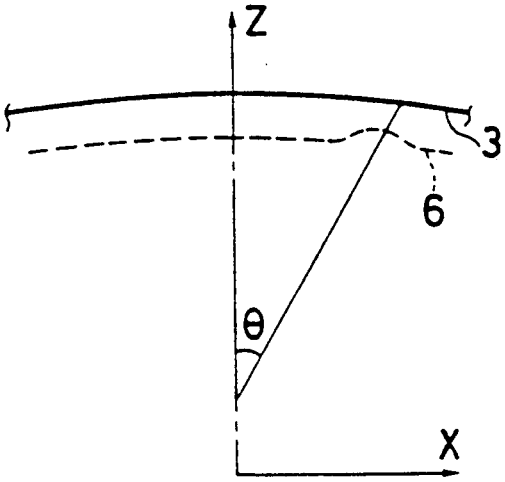
FIG. 5 illustrates doming caused by the image pattern in FIG. 4.

FIGS. 4 and 5 illustrate the effect of a particular image pattern comprising a single high-brightness area indicated by hatching in FIG. 4, the rest of the screen being dark. The shadow mask 6 receives an intense bombardment by electrons from the electron guns 15 in the high-brightness area, which heats this area and causes it to expand. The result is a dome-shaped bulge as shown in FIG. 5.

Figure 6:
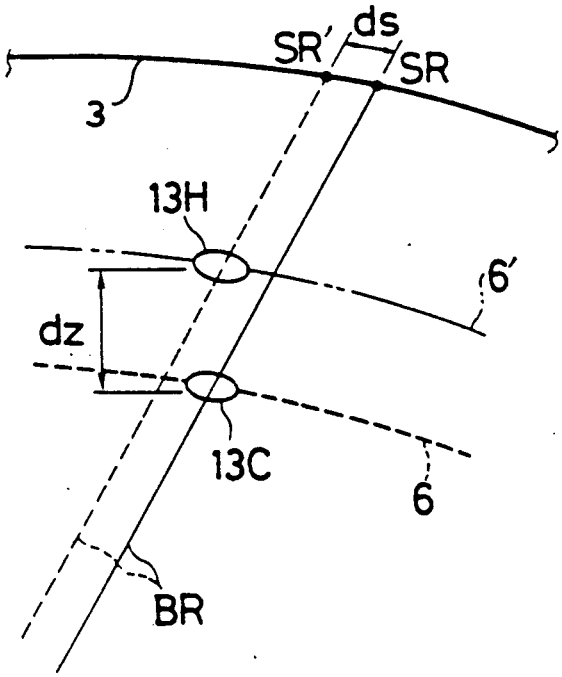
FIG. 6 illustrates the landing error caused by doming.

FIG. 6 shows how doming gives rise to landing error. When the shadow mask 6 is cool, the electron beam BR, for example, passes through a perforation in the shadow mask at the position 13C and lands on the phosphor 3 at a location SR in a red phosphor stripe. Doming caused by local heating moves the shadow mask forward to the position marked 6', the distance of forward movement being indicated as dz. As a result, the electron beam BR passes through the shadow mask at the position 13H and lands on the phosphor 3 at the location SR', which is shifted from SR by an amount is toward the center of the screen. If the landing error ds is large, part or all of the beam may land in the wrong phosphor stripe, thus degrading the color purity of the image.

Although local doming of the type illustrated in FIGS. 4 and 5 is somewhat unusual, it is quite common for doming to occur over the entire shadow mask 6, due to general eating of the shadow mask 6 by electron bombardment. In this case the size of the landing error ds depends on the angle $\theta$ between the electron beam and the z-axis.

Figure 7:
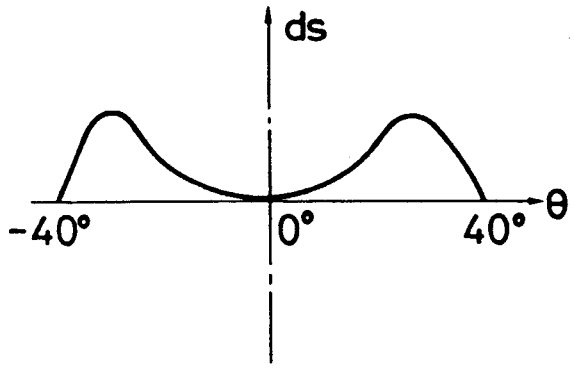
FIG. 7 is a graph of landing error as a function of beam angle.

FIG. 7 shows this dependence graphically, with ds on the vertical axis and the beam angle $\theta$ on the horizontal axis. If the picture tube has the commonly-employed deflection angle of 90°, then $\theta$ can vary up to 40° from the z-axis. Landing error does not occur at the edges of the screen because these areas are close to the frame 7 which prevents the shadow mask 6 from doming. Landing error does not occur at the center of the screen, because there the direction of doming coincides with the direction of the electron beam, both directions being parallel to the z-axis. The landing error is largest at intermediate positions between the center and edges. For a picture tube with a 90° deflection angle, the maximum landing error occurs around $\theta = \pm 30°$ as shown in FIG. 7.

Figure 8:
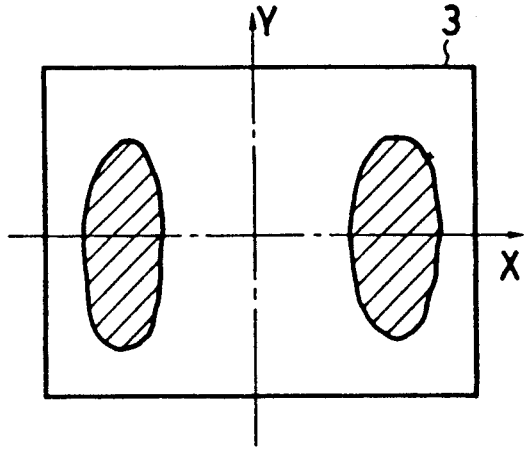
FIG. 8 shows the areas of maximum degradation of color purity due to landing error.

FIG. 8 shows the areas in which the doming effect illustrated in FIG. 7 causes the greatest color purity degradation. Due to the stripe configuration of the phosphors, vertical landing error does not degrade color purity; it is only the horizontal landing error that matters. Color purity degradation tends to be most prominent in the hatched areas, where $\theta < 20°$.

Figure 9:
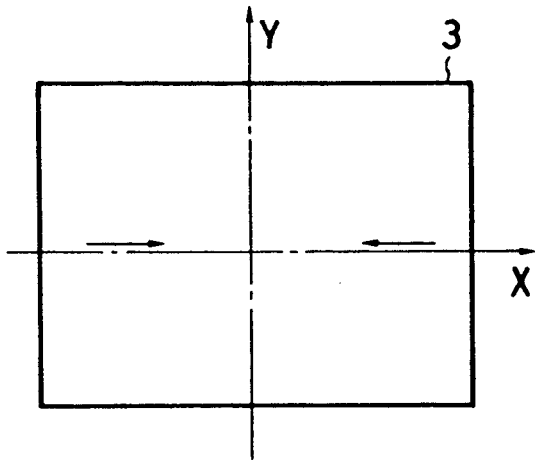
FIG. 9 illustrates the direction of the landing error in FIGS. 7 and 8.

FIG. 9 shows the direction of the landing error in the hatched areas in FIG. 8. In both areas, doming shifts the landing point toward the center of the screen, as was indicated in FIG. 6.

Next the principle of operation of the present invention will be explained with reference to FIGS. 10 to 12.

The novel feature of this invention is the auxiliary deflection devices 20 which change the direction of the electron beams before they pass through the shadow mask. Briefly stated, the effect of the change in direction is to align the electron beams with the doming direction. Thus, even if doming occurs, it does not change the landing point of the beam in the horizontal direction.

Figure 10:
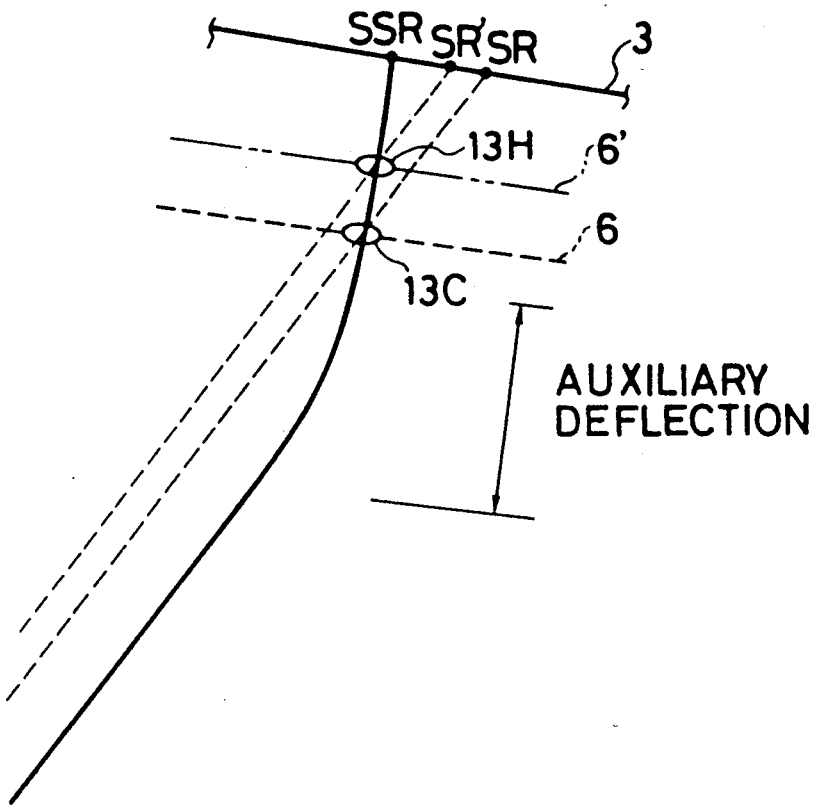
FIG. 10 shows how landing error is substantially eliminated by the present invention.
Figure 11:
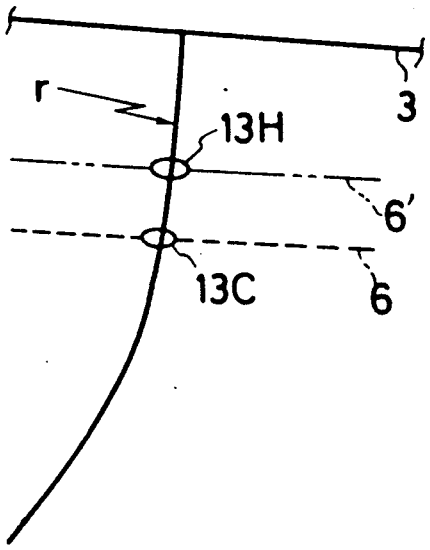
FIG. 11 is a variation of FIG. 10.

This is shown schematically in FIG. 10. After its original deflection by the deflection yoke 11, an electron beam travels in a straight line until it enters the magnetic field generated by the auxiliary deflection devices 20, around the middle of the drawing. This magnetic field deflects the beam in the horizontal direction toward the center of the screen. After leaving this magnetic field, the beam travels in a straight line again, now horizontally aligned with the direction of doming. Passing through the perforation 13C in the shadow mask 6, the beam lands on the phosphor 3 at the point SSR. If heating causes the shadow mask 6 to dome forward to the position 6', the beam passes through the perforation at the position 13H and lands at the same point SSR; there is substantially no landing error in the horizontal direction, hence no significant degradation of color purity.

For comparison, FIG. 10 also shows how the beam would travel without the auxiliary deflection devices 20. In this case the beam lands at the point SR when the shadow mask 6 is cool, but at the point SR' if the shadow mask 6 is heated and domes forward degrading color purity as already explained.

It is not necessary for the beam to follow a straight path when it passes through the shadow mask 6. Substantially the same reduction of landing error can be achieved if the beam follows a slightly curved path with a radius of curvature r as indicated in FIG. 11.

The novel shadow-mask color picture tube does not, of course, cause all three electron beams to be exactly aligned with the doming direction. As in the prior art, the three beams must pass through the shadow mask 6 at slightly different angles so that they will land on the phosphor 3 in different locations. However the auxiliary deflection devices 20 in this invention align all three beams sufficiently close to the doming direction so that the landing error caused by doming is not large enough to degrade color purity significantly.

Figure 12:
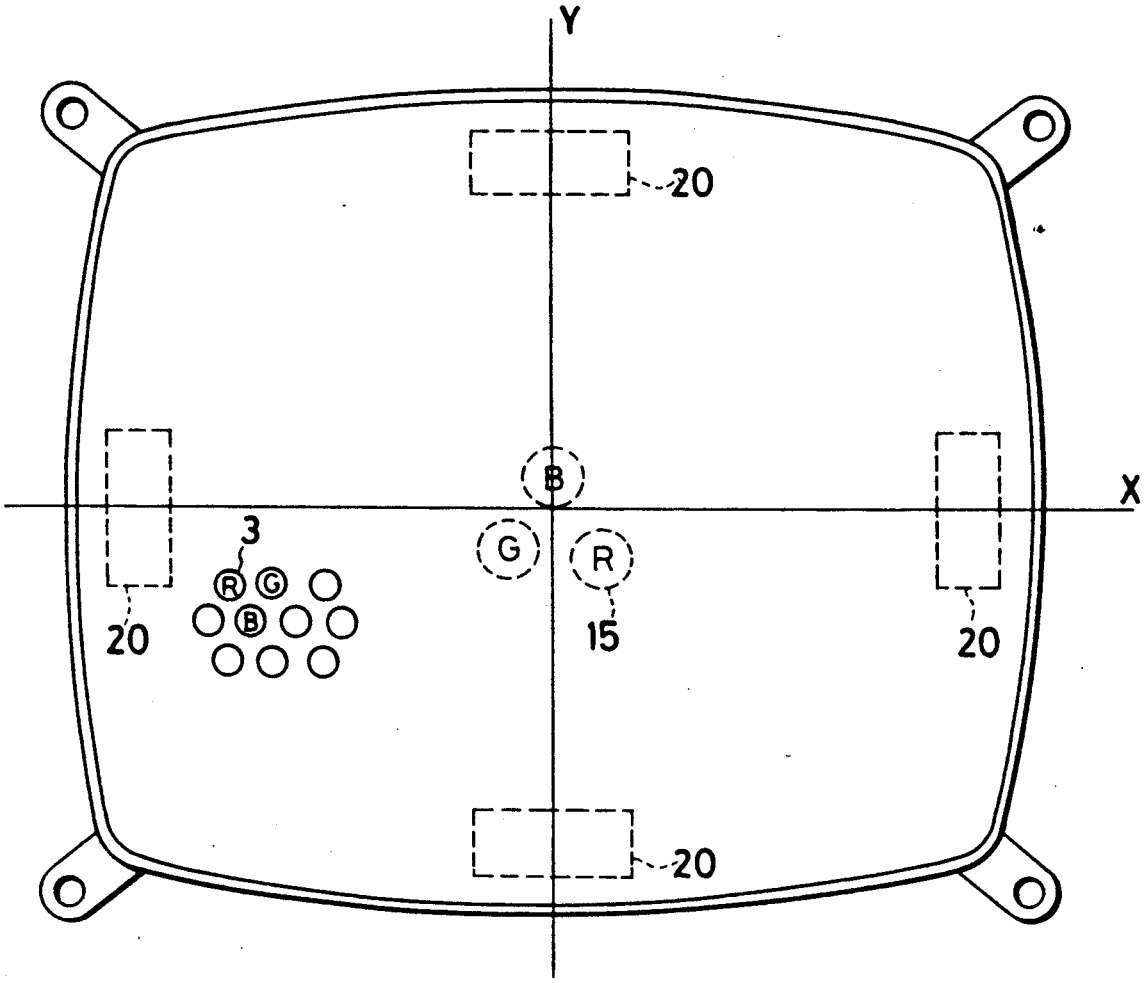
FIG. 12 is a front view of another novel shadow-mask color picture tube embodying the present invention.

FIG. 12 shows a front view of another novel shadow-mask picture tube embodying the present invention. The electron guns 15 in this shadow-mask picture tube are disposed in a triangular delta arrangement instead of an in-line arrangement. The phosphor 3 includes red, green, and blue phosphor dots disposed in a similar triangular arrangement instead of in stripes. In this arrangement, both horizontal and vertical landing error can degrade color purity. Accordingly, four auxiliary deflection devices 20 are provided, one pair disposed on the right and left and one pair disposed above and below. The pair of auxiliary deflection devices 20 disposed on the right and left are electrically coupled to the horizontal deflection coils in the deflection yoke; the pair of auxiliary deflection devices 20 disposed above and below are electrically coupled to the vertical deflection coils in the deflection yoke.

Other elements of this shadow-mask picture tube are identical to the elements described in FIGS. 1 and 2, and its theory of operation is the same as illustrated in FIGS. 3 through 11, except that the auxiliary deflection devices align the electron beams with the doming direction both horizontally and vertically. Further explanation will be omitted.

In some cases it may not be possible to align the beams with the doming direction over the whole screen. In these cases the auxiliary deflection devices 20 can be adjusted to align the beams with the doming direction in the areas in which color purity degradation is most prominant. This, therefore, reduces the landing error where it is most necessary.

Figure 13:
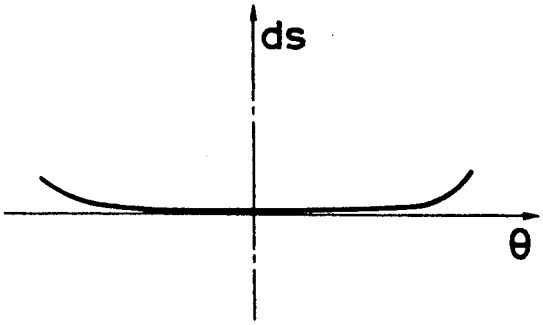
FIG. 13 shows the landing error characteristic of a tension-mask color picture tube.

Some shadow-mask color picture tubes have so-called tension masks. There are shadow masks that are mounted under tension so &hat heating causes the shadow mask to expand in the same plane instead of doming forward. The landing error characteristic of these picture tubes is as shown in FIG. 13 instead of FIG. 7. In these picture tubes, the landing error increases toward the edges of the screen. With suitable adjustment of the strength of the magnetic field produced by the auxiliary deflection devices 20, the present invention is also applicable to such tension-mask color picture tubes, and can be used to improve their color purity. More specifically, the auxiliary deflection devices 20 should deflect the electron beams by an amount proportional in magnitude, but opposite in direction of expansion of the shadow mask.

The scope of this invention is not limited to the apparatus shown in the drawings, but includes many modifications and variations which will be apparent to one skilled in the art. For example, the auxiliary deflection devices 20 can be mounted inside the funnel 4 instead of outside as shown in the drawings. Instead of deflection coils, the auxiliary deflection devices 20 can include permanent magnets, or a combination, of permanent magnets and deflection coils, or electrostatic devices for generating an electrostatic field instead of a magnetic field to deflect the electron beams.

What is claimed is:

1. A shadow-mask color picture tube, comprising:

electron guns for generating a plurality of electron beams;

a deflection yoke including horizontal and vertical deflection coils, for deflecting said electron beams in the horizontal and vertical directions;

a faceplate disposed in the path of said electron beams, coated with phosphors that emit light of different colors when excited by said electron beams;

a shadow-mask including a metal plate perforated with holes, disposed between said deflection yoke and said faceplate; and auxiliary deflection means, disposed between said deflection yoke and said shadow-mask, for deflecting said electron beams in the horizontal direction, said auxiliary deflection means deflecting said electron beams by an angle substantially equal to the horizontal angle between said electron beams and the direction of doming of said shadow-mask caused by heating from electron bombardment, such that said electron beams are horizontally aligned with the doming direction, thereby minimizing landing error irrespective of the amount of doming occurring.

2. The shadow-mask color picture tube of claim 1, wherein said auxiliary deflection means includes a pair of deflection coils electrically coupled to the horizontal deflection coils in said deflection yoke.

3. The shadow-mask color picture tube of claim 1, wherein said auxiliary deflection means includes one of permanent magnets, a combination of permanent magnets and deflection coils, and electrostatic means for generating an electrostatic field to deflect the electron beams.

4. The shadow-mask color picture tube of claim 1, further comprising auxiliary deflection means disposed between said deflection yoke and said shadow mask for deflecting said electron beams in the vertical direction.

5. The shadow-mask color picture tube of claim 4, wherein said auxiliary deflection means deflects said electron beams by an angle substantially equal to the horizontal and vertical angle between said electron beams and the direction of doming of said shadow-mask caused by heating from electron bombardment, such that said electron beams are horizontally and vertically aligned with the doming direction, thereby minimizing landing error irrespective of the amount of doming occurring.

6. The shadow-mask color picture tube of claim 5, wherein said auxiliary deflection means includes a pair of deflection coils electrically coupled to the horizontal deflection coils in said deflection yoke.

7. The shadow-mask color picture tube of claim 4, wherein said auxiliary deflection means includes a pair of deflection coils electrically coupled to the horizontal deflection coils in said deflection yoke.

8. The shadow-mask color picture tube of claim 4, wherein said auxiliary deflection means includes one of permanent magnets, a combination of permanent magnets and deflection coils, and electrostatic means for generating an electrostatic field to deflect the electron beams.

9. The shadow-mask color picture tube of claim 1, wherein said shadow mask is mounted under tension and said auxiliary deflection means deflects said electron beams by an amount proportional in magnitude but opposite in direction to the expansion of said shadow mask caused by heating.

10. A shadow-mask color picture tube, comprising:

electron guns for generating a plurality of electron beams;

deflection yoke, including horizontal and vertical deflection coils, for deflecting said electron beams in horizontal and vertical directions;

faceplate, disposed in the path of said electron beams, coated with phosphors that emit colored light when excited by said electron beams;

a shadow-mask including a metal plate perforated with holes, disposed between said deflection yoke and said faceplate; and auxiliary deflection means, disposed between said deflection yoke and said shadow-mask and electrically coupled to at least said horizontal deflection coils of said deflection yoke, for deflecting said electron beams by an angle substantially equal to the horizontal and vertical angle between said electron means and direction of doming of said shadow-mask such that the electron beams are horizontally and vertically aligned with the predetermined doming direction of the perforated holes of the shadow-mask to minimize landing errors in the alignment of the electron beams and the phosphors of the faceplate caused by heating from electron bombardment of the electron beams.

11. The shadow-mask color picture tube of claim 10, wherein said auxiliary deflection means includes one of permanent magnets, a combination of permanent magnets and deflection coils, and electrostatic means for generating an electrostatic field to deflect the electron beams.

12. The shadow-mask color picture tube of claim 10, wherein said shadow-mask is mounted under tension and said auxiliary deflection means deflects said electron beams by an amount proportional in magnitude, but opposite in direction, to expansion of said shadow-mask caused by heating.

13. A method of minimizing landing errors between each of a plurality of electron beams and corresponding phosphor elements, necessary for forming a color image on a shadow-mask color picture tube, due to doming of a shadow-mask caused by heating from the electron beams, comprising the steps of:

(a) generating a plurality of electron beams;

(b) deflecting the plurality of electron beams in horizontal and vertical directions by primary horizontal and vertical deflection coils;

(c) redeflecting the plurality of electron beams in at least the horizontal direction by secondary horizontal deflection coils, electrically coupled with the primary horizontal deflection coils to at least horizontally align each of the plurality of electron beams with one of a plurality of holes in the shadow-mask, the electron beams at least horizontally aligned along a predetermined direction of doming of the plurality of holes;

(d) exciting each of a plurality of phosphors to emit colored light and form the color image, by contact with a corresponding one of the plurality of electron beams, landing error between the electron beams and a corresponding phosphor being minimized irrespective of the amount of doming occurring.

14. The method of claim 13, wherein said plurality of electron beams are redeflected in both the horizontal and vertical directions to both horizontally and vertically align each of the plurality of electron beams with one of the holes in the shadow-mask to thereby minimize landing error irrespective of the amount of doming occurring in the horizontal and vertical directions.

15. The method of claim 14, wherein said step (c) of redeflecting redeflects the plurality of electron beams by an angle substantially equal to the horizontal and vertical angle between the plurality of electron beams and a predetermined direction of doming of the shadow-mask, the plurality of electron beams thus horizontally and vertically aligned with the doming direction.

* * * * *